US007328664B2

(12) United States Patent
Hillenbrand

(10) Patent No.: US 7,328,664 B2
(45) Date of Patent: Feb. 12, 2008

(54) EMBOSSED TUFTING NEEDLE

(75) Inventor: Bernd Hillenbrand, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 10/593,450

(22) PCT Filed: Feb. 17, 2005

(86) PCT No.: PCT/EP2005/001585

§ 371 (c)(1),
(2), (4) Date: Sep. 19, 2006

(87) PCT Pub. No.: WO2005/095703

PCT Pub. Date: Oct. 13, 2005

(65) Prior Publication Data

US 2007/0193487 A1 Aug. 23, 2007

(30) Foreign Application Priority Data

Mar. 20, 2004 (DE) ..... 20 2004 004 401 U

(51) Int. Cl.
*D05C 15/20* (2006.01)

(52) U.S. Cl. ..... 112/222

(58) Field of Classification Search ..... 28/115; 112/222, 80.05, 80.06, 80.01, 80.16, 80.17
See application file for complete search history.

(56) References Cited

U.S. PATENT DOCUMENTS 3,954,072 A * 5/1976 Zocher ..... 112/222
4,194,457 A * 3/1980 Parsons ..... 112/222
4,563,961 A * 1/1986 Beyer et al. ..... 112/222
5,046,438 A * 9/1991 Hakui ..... 112/222
5,158,022 A 10/1992 Dugge et al.
5,189,966 A 3/1993 Satterfield
5,215,021 A * 6/1993 Fuhrmann ..... 112/222
6,142,088 A 11/2000 Beyer

FOREIGN PATENT DOCUMENTS

EP 0874932 11/1998
WO WO9006391 6/1990

* cited by examiner

*Primary Examiner*—Danny Worrell
(74) *Attorney, Agent, or Firm*—Fitch Even Tabin & Flannery; Norman N. Kunitz

(57) ABSTRACT

A novel tufting needle (4) is distinguished by a hollow flute (15) which is preferably symmetrical to a central plane (29) and which is bilaterally provided with chamfers (33, 34). The chamfers (33, 34) are, in an inward-located, that is, in a region lying close to the central plane (29), inclined at a small acute angle (α) to a reference plane (28), while in a region bordering an externally located rim (edges (46, 47)), the chamfers (33, 34) are inclined at a larger acute angle (β) to the reference plane (28). This feature improves the rigidity, the tufting properties and the mechanical strength, as well as the wear resistance of the novel tufting needle (4).

14 Claims, 3 Drawing Sheets

4
8
18
17
6
15
14
16
19
13
9
12
7
11
X
32
IV
31

EMBOSSED TUFTING NEEDLE

CROSS REFERENCE TO RELATED APPLICATION

This application is the National Stage filing under 35 U.S.C. 371 of International Application No. PCT/EP2005/001585, filed Feb. 17, 2005, and claims priority of German Patent Application Number 20 2004 004 401.3, filed Mar. 20, 2004, which is incorporated herein, in its entirety, by reference.

BACKGROUND OF THE INVENTION

The invention relates to an improved tufting needle.

Tufting needles are known, for example, from European Patent No. EP 0 874 932 B1. The tufting needle described therein has a basic body whose holding end is held in a holding body, and its other end terminates in a tip adjoined by an eyelet. Further, a yarn groove extends to the eyelet along the shank.

U.S. Pat. No. 5,189,966 discloses a tufting needle which has, for a looper, arcuate chamfers at its flanks. However, it does not have a true hollow flute. In the region of the chamfers the shaft has a cross section shaped like an arcuate triangle.

Further, International Patent Application No. WO 90/06391 discloses a tufting needle which is provided with a hollow flute in the vicinity of the eyelet. The hollow flute serves for providing a better access to the yarn for a looper or other tools. The tufting needle is flattened and mechanically weakened in the region of the hollow flute.

Loopers may abut the tufting needle in the region of the hollow flute and reach into the hollow flute transversely to the needle. During such an operation in time wear appears on the tufting needle because of material abrasion. The tufting needle has to be replaced in case such wear becomes excessive or even results in a break-through to the yarn groove. These occurrences limit the service life of the tufting needle.

In the course of the above-noted operation it may occur that, because of uncertainties in the process, the loopers abut the flanks of the tufting needles and thus miss the hollow flute.

It is the object of the invention to increase the service life of a tufting needle and, at the same time, to enlarge the inlet space leading to the hollow flute.

SUMMARY OF THE INVENTION

This object is achieved by the tufting needle as defined in claim 1:

The tufting needle according to the invention has a hollow flute provided with at least one chamfer which has a steeper inclination at its edge adjoining the needle flank than further inward. According to the wording of claim 1 this means that the chamfer in the vicinity of the needle center forms with the reference plane an acute angle $\alpha$ which is smaller than a further outward-lying acute angle $\beta$. In this manner the slide angle between a looper and the chamfer of the hollow flute is rendered less pronounced. The looper abuts the chamfer at an outer region which is at the angle $\beta$. The latter is, for example, in the range of from 35° to 50°, and is preferably 45°. In this manner a high degree of reliability is ensured during the reception of the yarn loop, because the inlet space for the looper is increased in the region of the hollow flute. An abutting of the looper on the flanks of the needle is virtually avoided. The angle of the chamfer drops inward to a smaller magnitude between 20° and 40°, preferably to 30°. In this manner the friction between the looper and the hollow flute is reduced which results in a diminished wear of the looper and the tufting needle.

By means of the radially viewed convex configuration of the chamfer of the hollow flute the thickness of the wall between the chamfer and the yarn groove is increased as compared to planar chamfers. In this manner the service life of the tufting needle is increased up to a possible break-through by the looper. Both factors, that is, the reduced friction between the needle and the looper as well as the thicker wall between the yarn groove and the chamfer significantly result, taken individually and in combination, in an increase of the service life of the needle.

The needle body may be arranged in the tufting module at a setting angle. This means that the reference plane of the tufting needle is not perpendicular to a setting surface of a needle board. Such a setting which normally increases the friction between the looper and the needle, is well tolerated by the needle according to the invention.

The needle body is preferably flattened; this applies particularly to the region of the hollow flute. The portion adjoining the hollow flute too, may have a flattened structure. This feature results in a good elasticity of the needle in a lateral direction thereof and in a high degree of needle rigidity in a lateral direction perpendicular thereto. The latter direction, as a rule, coincides with the transporting direction of the base material.

The tufting needle may have a yarn groove. It may be omitted, however, if not required.

The hollow flute is preferably of symmetrical structure with respect to a central plane, whereby the needle may be used in an either right-hand or left-hand orientation.

In particular, the hollow flute my be provided bilaterally with chamfers to make possible the last-discussed feature. In such an instance, the hollow flute is preferably again symmetrical to the central plane. The mode of operation in a right-hand orientation or a left-hand orientation is then identical. The cross section of the needle in such a case has an upward rounded or faceted, roof-like shape in the region of the hollow flute. Despite the bilateral chamfering of the hollow flute, a large wall thickness toward the yarn groove is obtained.

It is also feasible to facet the chamfers, in which case the individual facets may join one another by means of spacious roundings. It is also possible to structure the hollow flute rounded overall, in which case it forms a longitudinally stretched saddle surface. The noted flattened portions and facets on the tufting needle may be obtained by embossing. The thus-produced flattened regions may project laterally beyond the non-embossed shank. A projection of the outer edges of the yarn groove in the region of the hollow flute may amount to approximately between 5% and 20% of the shank width. This enhances, for example, the stability of the tufting needle.

Further, the symmetrical arrangement of the chamfers may result in an improved wear behavior of the needles for an additional reason. In case of a unilateral yarn layout, the looper is prevented to a great extent from scraping on the edge of the hollow flute during the return stroke of the needle. The danger that sharp edges will be formed which may damage the carrier material is reduced.

Further details of advantageous features of the invention are contained in the drawing, the description or the claims.

BRIEF DESCRIPTION OF THE DRAWINGS

In the drawing, which illustrates an embodiment of the tufting needle according to the invention.

DETAILED DESCRIPTION OF THE INVENTION

Figure 1:
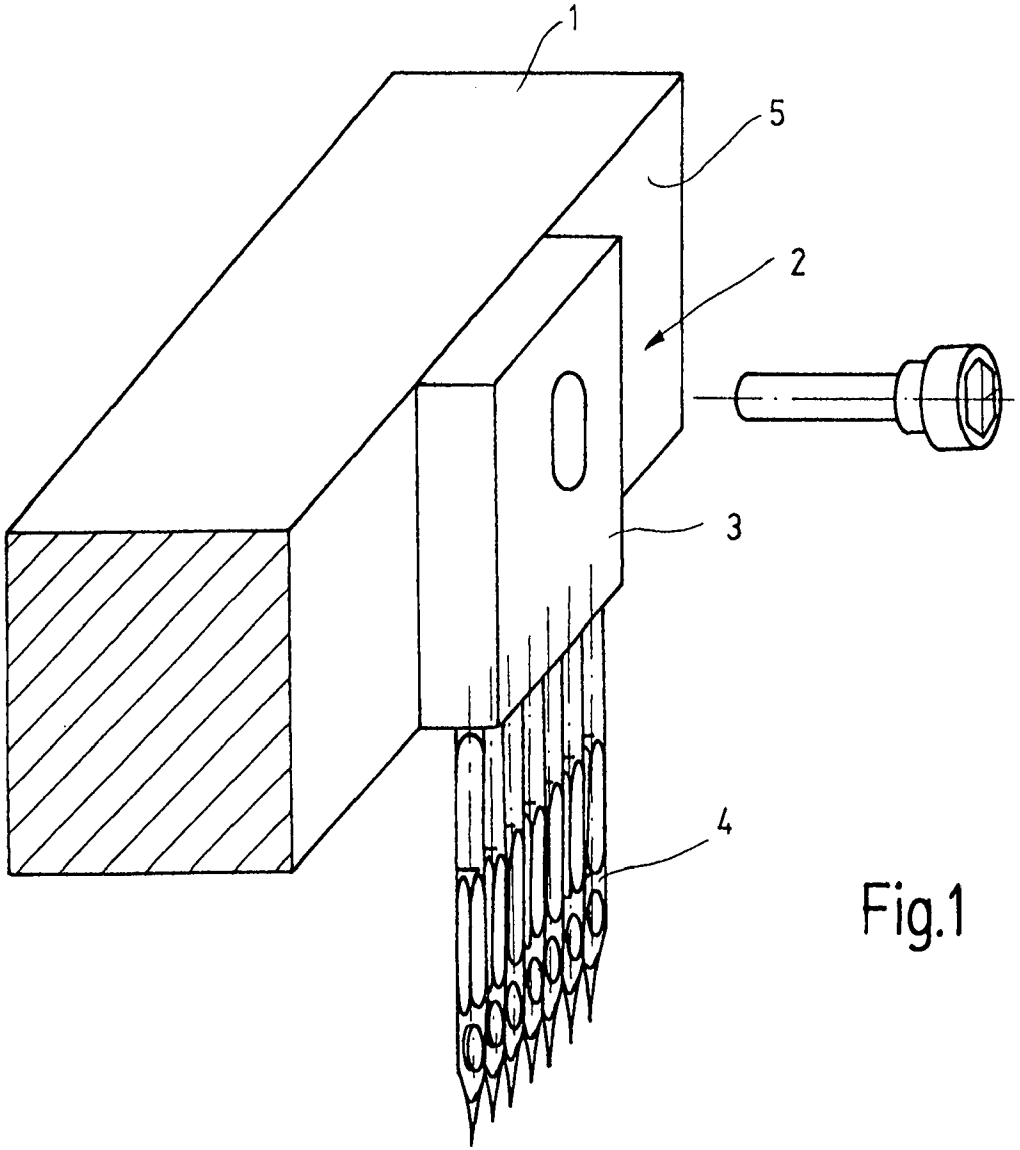
FIG. 1 is a fragmentary perspective view of a needle board and a tufting needle module supported thereby, having several, mutually parallel-oriented tufting needles.

FIG. 1 schematically shows a needle bar 1 supporting a tufting module 2. The tufting module 2 comprises a body 3 in or on which a group of tufting needles 4 are held. The body 3 lies with a flat side on the front side 5 of the needle board 1. The tufting needles 4 are spaced parallel to one another and are downward oriented.

Figure 2:
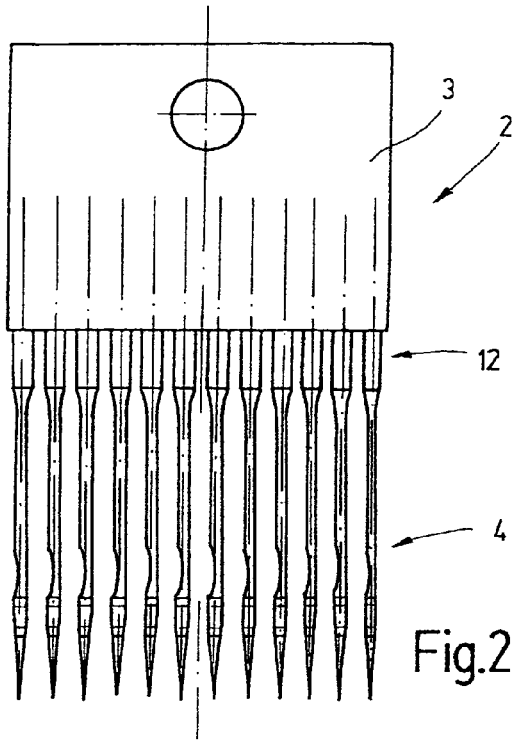
FIG. 2 is a front elevational view of the module according to FIG. 1.
Figure 3:
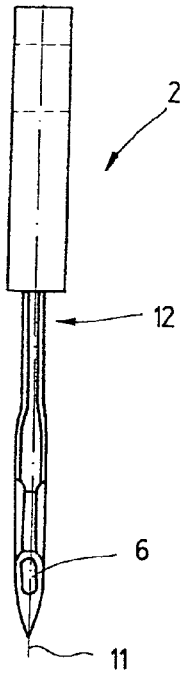
FIG. 3 is a side elevational view of the module according to FIG. 1.

FIGS. 2 and 3 separately show the tufting module 2. As seen in FIG. 2, the tufting needles 4 are of identical structure and are flattened. They are held in the body 3 at their upper end. Their eyelets 6, as seen in FIG. 3, are, for example, in alignment with one another.

Figure 4:
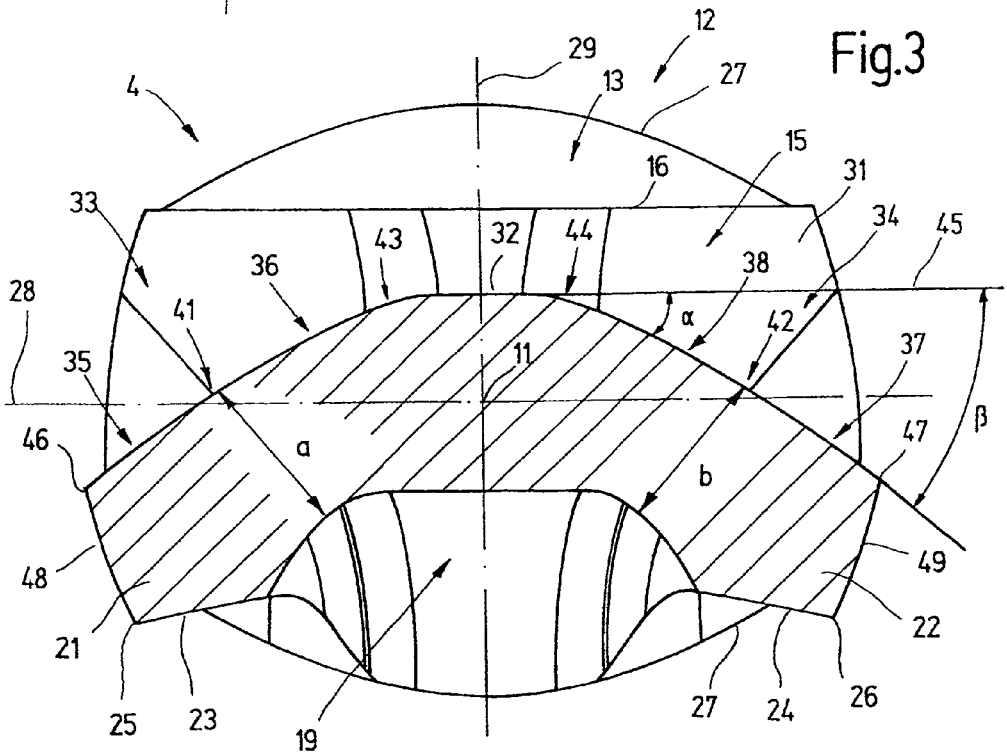
FIG. 4 is a cross section of a tufting needle taken through the region of its hollow flute.
Figures 5, 6:
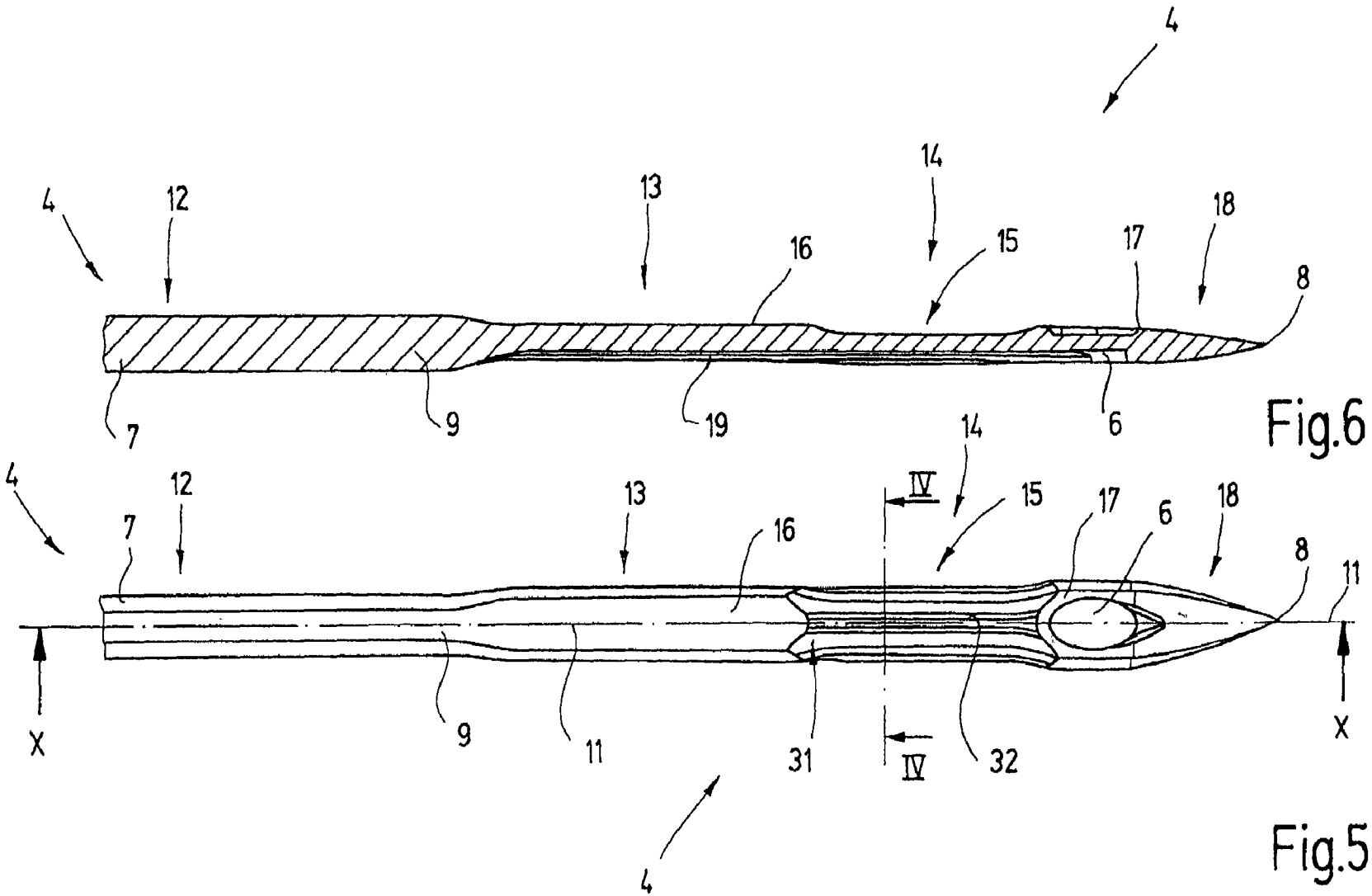
FIG. 5 is a front elevational view of one of the tufting needles of the modules according to FIGS. 2 and 3 and FIG. 6 is a longitudinal sectional view of the tufting needle according to FIG. 5.

FIGS. 4, 5 and 6 illustrate the structure of one individual tufting needle 4. As seen in FIG. 6, the tufting needle 4 has a needle body 7 which constitutes a shank 9 extending to a tip 8 which marks the center of the shank 9. A longitudinal axis 11 defining the length direction of the needle body 7 and the shank 9 passes through the tip 8.

Starting from a first portion 12 which may also be regarded as the clamped portion and which has a substantially circular or at least a rounded cross section, a flattened portion 13 extends toward the tip 8. The flattened portion 13 is adjoined by a portion 14 which is provided with a hollow flute 15. The portion 13 is closed upward by a planar surface 16. The hollow flute 15, which is closer to the longitudinal axis 11 than the planar surface 16, forms a longitudinally stretched, saddle-shaped depression. The eyelet 6 is provided in the immediate vicinity of the hollow flute 15. The eyelet 6 is surrounded by a planar annular surface 17 which is preferably coplanar with the planar surface 16. From the annular surface 17 a portion 18 extends, in which the needle body 7 tapers toward the tip 8.

As particularly well seen in FIG. 6, in the side of the tufting needle 4 lying opposite the planar surface 16, a yarn groove 19 is formed which extends over the portions 13, 14 into the eyelet 6. The cross section of the yarn groove 19 is essentially constant along its entire length. FIG. 4 shows the cross section of the tufting needle 4, taken along the line IV-IV of FIG. 5. FIGS. 4 and 5 show structures on different scales. As illustrated in FIG. 4, the yarn groove 19 has preferably an approximately trapezoidal shape. The yarn groove 19 is bilaterally adjoined by legs 21, 22 which are bordered by planar surfaces 23, 24 at the side of the yarn groove. The planar surfaces 23, 24 form an obtuse angle with one another; they terminate in edges 25, 26 which lie radially significantly externally of an outline 27 which contains the portion 12 of the shank 9. The legs 21, 22 thus project beyond the outline 27.

In the illustration according to FIG. 4, the eyelet which is cut away and is thus not visible, has a vertical opening direction oriented perpendicularly to a reference plane 28. The latter, in turn, is parallel to the planar surface 16 and extends longitudinally through the tufting needle 4 and thus contains the longitudinal axis 11. Perpendicularly to the reference plane 28 a central plane 29 is to be imagined which intersects the reference plane 28 in a line of intersection which is the longitudinal axis 11. The central plane 29 constitutes a symmetry plane for the tufting needle 4.

The shape of the hollow flute 15 is particularly well seen in FIG. 4. Starting from an edge bordering the planar surface 16, a rounding 31 is provided which changes into linear surfaces relative to the length direction. These surfaces comprise a planar surface 32 which is symmetrical to the central plane 29 and which is oriented preferably parallel to the reference plane 28. Bilaterally of the planar surface 32 chamfers 33, 34 are arranged which intersect the reference plane 28 and which are symmetrical to the central plane 29. In the present embodiment the chamfers 33, 34 are faceted. Accordingly, each chamfer 33, 34 has two strip-shaped planar surfaces 35, 36 and, respectively, 37, 38 which change into a rounded or arcuate surface 41, 42. The surface 41 lies between the planar surfaces 35, 36 and the surface 42 lies between the planar surfaces 37, 38. Further, the chamfers 33, 34 join the planar surface 32 with the intermediary of rounded or arcuate surfaces 43, 44. The planar surfaces 35, 36 as well as 37, 38 form in each instance pair-wise an obtuse angle with one another. In this manner, as shown in FIG. 4, they are oriented at different angles to the reference plane 28 or to a plane parallel thereto. The planar surface 38 forms an acute angle $\alpha$ with a line 45 which is parallel to the reference plane 28. The same applies to the planar surface 36. The planar surface 37 forms an acute angle $\beta$ with the line 45. The same applies to the planar surface 35. The angle $\alpha$ is smaller than the angle $\beta$. The angle $\alpha$ lies preferably in the range of 20° to 40°. In the present preferred embodiment $\alpha$ is 30°. The angle $\beta$ lies preferably in the range of 35° to 55°. In the present preferred embodiment $\beta$ is 45°. The planar surfaces 35, 37 are disposed such that they terminate preferably in an edge 46, 47 which lies externally of the outline 27. In this manner the outer flanks 48, 49 of the portion 14 are disposed externally of the outline 27. The flanks 48, 49 are preferably slightly curved.

The tufting needle 4 described up to this point operates as follows:

In use, a yarn is guided through the yarn groove and the eyelet 6. As the tufting needle 4 pierces a base material, the yarn is pulled therethrough by the eyelet. In the vicinity of its lower point of reversal, a hook-shaped looper is moved toward the tufting needle 4. First the looper abuts with its tip the planar surface 37. Based on the substantial inclination of the surface 37 to the reference plane 28 (the acute angle $\beta$), a large distance between the edge 47 and the line 45 is obtained. Independently of any non-alignment, tolerances, inaccuracies or bendings, the tip of the looper thus securely abuts the chamfer 34. Then it first slides on and along the planar surface 37 and thereafter reaches the planar surface 38. Friction is reduced by virtue of the small angle (the smaller acute angle $\alpha$) of the planar surface 38 to the reference plane 28. Subsequently, the looper is guided over and beyond the planar surface 32, so that during the return stroke of the needle, the looper may firmly hold the yarn which pierced the base material by the eyelet.

The arching present in the chamfers 33, 34 results, at 41 and, respectively, at 42, in an enlargement of the wall thickness a, b toward the yarn groove 19. This eventually enhances not only the rigidity of the tufting needle 4, but its wear resistance as well. A gradual abrasion of such a wall leads to an impermissible wear only after a very long use.

| List of Reference Characters: | |
|---|---|
| 1 | needle board |
| 2 | tufting module |
| 3 | body |
| 4 | tufting needle |
| 5 | front side |
| 6 | eyelet |
| 7 | needle body |
| 8 | tip |
| 9 | shank |
| 11 | longitudinal axis |
| 12, 13, 14 | portion |
| 15 | hollow flute |
| 16 | planar surface |
| 17 | annular surface |
| 18 | portion |
| 19 | yarn groove |
| 21, 22 | legs |
| 23, 24 | planar surfaces |
| 25, 26 | edges |
| 27 | outline |
| 28 | reference plane |
| 29 | central plane, needle center |
| 31 | rounding |
| 32 | planar surface |
| 33, 34 | chamfers |
| 35, 36; 37, 38 | planar surfaces |
| 41, 42; 43, 44 | surface |
| 45 | line |
| 46, 47 | edge |
| 48, 49 | flanks |

The invention claimed is:

1. A tufting needle (4) comprising a needle body (7) having a shaft (9) which, at an end, terminates in a tip (8) and which is provided with an eyelet (6) and, in the vicinity thereof, has a hollow flute (15); the opening direction of the eyelet (6) is oriented perpendicularly to a reference plane (28), wherein the hollow flute (15) is provided with at least one chamfer (33, 34) which is arranged at an inclination to the reference plane (28) and which, in the vicinity of the needle center (29), forms an acute angle ($\alpha$) with the reference plane (28); the angle ($\alpha$) is smaller than an angle ($\beta$) which is formed by the chamfer (33, 34) with the reference plane (28) at a greater lateral distance from the needle center (29).

2. The tufting needle as defined in claim 1, characterized in that the needle body (7) is flattened.

3. The tufting needle as defined in claim 1, characterized in that the needle body (7) is provided with a yarn groove (19) at its side remote from the hollow flute (15).

4. The tufting needle as defined in claim 1, characterized in that the hollow flute (15) has the shape of a longitudinally stretched saddle.

5. The tufting needle as defined in claim 1, characterized in that it is symmetrical to a central plane (29) which is perpendicular to the reference plane (28) and which is oriented in the direction (11) of needle length.

6. The tufting needle as defined in claim 1, characterized in that the hollow flute (15) is bilaterally provided with chamfers (33, 34).

7. The tufting needle as defined in claim 6, characterized in that the chamfers (33, 34) are symmetrical to a central plane (29) which is perpendicular to the reference plane (28) and which is oriented in the direction (11) of needle length.

8. The tufting needle as defined in claim 1, characterized in that the chamfer (33, 34) extends along the entire length of the hollow flute (15).

9. The tufting needle as defined in claim 1, characterized in that the chamfer (33, 34) has at least two facet surfaces (35, 36; 37, 38), each forming a different angle ($\alpha$, $\beta$) with the reference plane (28).

10. The tufting needle as defined in claim 9, characterized in that the facets (35, 36; 37, 38) change into a rounded surface (41, 42).

11. The tufting needle as defined in claim 1, characterized in that the chamfer (33, 34) is constituted by an arcuate surface (41, 42).

12. The tufting needle as defined in claim 1, characterized in that the width of the shank (9) is, in the region of the hollow flute (15), enlarged relative to the width in other shank parts.

13. The tufting needle as defined in claim 1, characterized in that in the hollow flute (15), between the chamfers (33, 34), a planar surface (32) is provided which is deeper than the adjoining surfaces (16, 17).

14. The tufting needle as defined in claim 1, characterized in that the opening direction of the eyelet (6) is oriented perpendicularly to the reference plane (28) and that the hollow flute (15) is parallel to the reference plane (28).

* * * * *